US007144135B2

(12) United States Patent
Martin et al.

(10) Patent No.: US 7,144,135 B2
(45) Date of Patent: Dec. 5, 2006

(54) LED LAMP HEAT SINK

(75) Inventors: Paul S. Martin, Pleasanton, CA (US); Franklin J. Wall, Jr., Vacaville, CA (US)

(73) Assignee: Philips Lumileds Lighting Company, LLC, San Jose, CA (US)

( * ) Notice: Subject to any disclaimer, the term of this patent is extended or adjusted under 35 U.S.C. 154(b) by 257 days.

(21) Appl. No.: 10/723,711

(22) Filed: Nov. 26, 2003

(65) Prior Publication Data

US 2005/0111234 A1 May 26, 2005

(51) Int. Cl.
*F21V 29/00* (2006.01)

(52) U.S. Cl. ..... 362/294; 362/345; 362/373

(58) Field of Classification Search ..... 362/294, 362/345, 373, 547
See application file for complete search history.

(56) References Cited

U.S. PATENT DOCUMENTS 2,933,596 A * 4/1960 Tolbert ..... 362/294
4,321,659 A * 3/1982 Wheeler ..... 362/293
4,630,182 A * 12/1986 Moroi et al. ..... 362/294
5,806,965 A * 9/1998 Deese ..... 362/249
6,220,722 B1 4/2001 Begemann ..... 362/231
6,227,686 B1 * 5/2001 Takahashi et al. ..... 362/345
6,367,949 B1 4/2002 Pederson ..... 362/240
6,609,804 B1 8/2003 Nolan et al. ..... 362/20
6,621,239 B1 9/2003 Belliveau ..... 315/312
6,635,999 B1 * 10/2003 Belliveau ..... 315/149
6,676,283 B1 * 1/2004 Ozawa et al. ..... 362/547
6,719,558 B1 * 4/2004 Cao ..... 433/29
6,746,885 B1 * 6/2004 Cao ..... 438/26
6,793,374 B1 * 9/2004 Begemann ..... 362/294
6,954,270 B1 * 10/2005 Ostler et al. ..... 356/318
6,955,440 B1 * 10/2005 Niskanen ..... 362/96

* cited by examiner

*Primary Examiner*—Sandra O'Shea
*Assistant Examiner*—James W Cranson, Jr.
(74) *Attorney, Agent, or Firm*—Patent Law Group LLP

(57) ABSTRACT

An LED lamp includes an exterior shell that has the same form factor as a conventional incandescent light bulb, such as a PAR type bulb. The LED lamp includes an optical reflector that is disposed within the shell and that directs the light emitted from one or more LEDs. The optical reflector and shell define a space that is used to channel air to cool the device. The LED is mounted on a heat sink that is disposed within the shell. A fan moves air over the heat sink and through the spaced defined by the optical reflector and the shell. The shell includes one or more apertures that serve as air inlet or exhaust apertures. One or more apertures defined by the optical reflector and shell at the opening of the shell can also be used as air exhaust or inlet apertures.

20 Claims, 6 Drawing Sheets

LED LAMP HEAT SINK

FIELD OF THE INVENTION

The present invention relates generally to a light emitting diode (LED) lamp, and in particular to cooling an LED lamp.

BACKGROUND

Recently there has been a trend in replacing conventional incandescent light bulbs with LED. For example, traffic control signals and automobile brake lights are often manufactured using LEDs. The replacement of conventional incandescent light bulbs with one or more LEDs is desirable because incandescent bulbs are inefficient relative to LEDs, e.g., in terms of energy use and longevity.

While it is desirable to replace incandescent light bulbs with LEDs, there are some lighting fixtures, however, where replacement is difficult because of the operating conditions. For example, in a spot lamp type application, where the light is recessed into a can, heat management is critical.

FIG. 1 illustrates a conventional PAR type incandescent lamp 10 recessed into a can 12. The can 12 is surrounded by insulation 14. A standard PAR incandescent type lamp emits most of its light in the infrared region, i.e., light with $\lambda>650$ nm, illustrated as arrows 16. Thus, along with light in the visible region, lamp 10 also emits heat.

LEDs, on the other hand, are designed to emit light at specific wavelengths. LED's that are designed to emit light in the visible spectrum emit no infrared radiation, but generate a significant amount of heat, e.g., approximately 80–90% of the input energy received by the LED is converted to heat, with the remainder converted to light. Accordingly, the heat that is generated by the LED must be dissipated. Unfortunately, in applications such as the recessed lighting fixture shown in FIG. 1, there is little or no air flow, making dissipation of the heat problematic.

Thus, what is needed is a LED lamp that can efficiently dissipate heat even when used in applications with little or no air flow.

SUMMARY

In accordance with an embodiment of the present invention, an LED lamp has the same form factor as a conventional incandescent light bulb, such as a PAR type bulb, and includes fan and a heat sink to dissipate heat. The LED lamp includes an optical reflector that is disposed within a shell. The optical reflector and shell define a space that is used to channel air to cool the device. The LED is mounted on a heat sink that is disposed within the shell. A fan moves air over the heat sink and through the spaced defined by the optical reflector and the shell. The shell includes one or more apertures that serve as air inlet or exhaust apertures. One or more apertures defined by the optical reflector and shell at the opening of the shell can also be used as air exhaust or inlet apertures.

Thus, in one aspect of the present invention, an apparatus includes a shell and an optical reflector disposed at least partially within the shell. A space is formed between the optical reflector and the shell. The apparatus further includes at least one light emitting diode disposed within the optical reflector and a heat sink disposed at least partially within the shell. The light emitting diode is mounted to the heat sink. The apparatus includes a motor and a fan disposed within the shell, where the fan is configured to move air over the heat sink and through the space.

Another aspect of the present invention is a method of cooling a light emitting diode in a lamp. The lamp includes an optical reflector that directs the light emitted from the light emitting diode. The method includes drawing air through at least one air inlet aperture and moving the air over a heat sink that is coupled to the light emitting diode. The method further includes moving the air along at least a portion of the optical reflector, and expelling the air through at least one air exhaust aperture. The method may include moving the along at least a portion of the optical reflector before the air is moved over the heat sink.

In yet another aspect of the present invention, an apparatus includes a light emitting diode and an optical reflector that controls the direction of light emitted from the light emitting diode. The apparatus has a heat sink to which the light emitting diode is mounted and a fan for moving air over the heat sink. The apparatus further includes an air flow channel through which the fan moves air. The air flow channel follows the general outline of the optical reflector.

DETAILED DESCRIPTION

Figure 2:
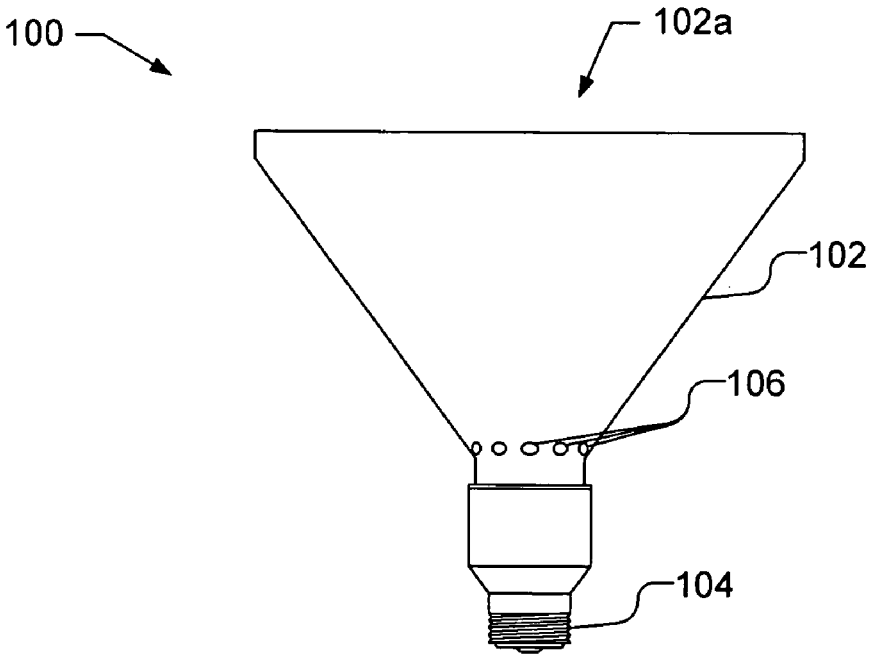
FIG. 2 illustrates a side view of an LED lamp 100 in accordance with an embodiment of the present invention.

FIG. 2 illustrates a side view of an embodiment of an LED lamp 100 that may be used in place of a conventional incandescent light bulb. LED lamp 100 includes an exterior shell 102 that has a similar form factor as conventional incandescent light bulbs, such as a parabolic aluminized reflector (PAR) type lighting device. Thus, as illustrated in FIG. 2, the shell 102 has a truncated cone shape that includes an opening 102*a* at the wide end and the narrow end is connected to a screw type base 104. The narrow end of the shell 102 may transition into a cylindrical shape, which is coupled to the base. The shell 102 may be screwed or glued to the base 104 or otherwise coupled to the base, e.g., using tabs and slots. The screw type base 104 is a conventional contact base and is compatible with Edison type sockets or other commonly used sockets. Of course, any desired contact base may be used with lamp 100. Moreover, if desired, form factors other than a PAR type light device may be used in accordance with the present invention.

The shell 102 includes one or more apertures 106 near the base 104. Where a plurality of apertures 106 is used, the apertures 106 are approximately equally spaced around the circumference of the shell 102 near the base 104. By way of example, there may be 12 apertures 106, each with a radius of approximately ⅛ inch. The apertures 106 serve as air intake or exhaust ports for the LED lamp 100. If a single aperture is used in place of the plurality of apertures, the aperture should be relatively large to provide an adequate air flow.

Figure 3:
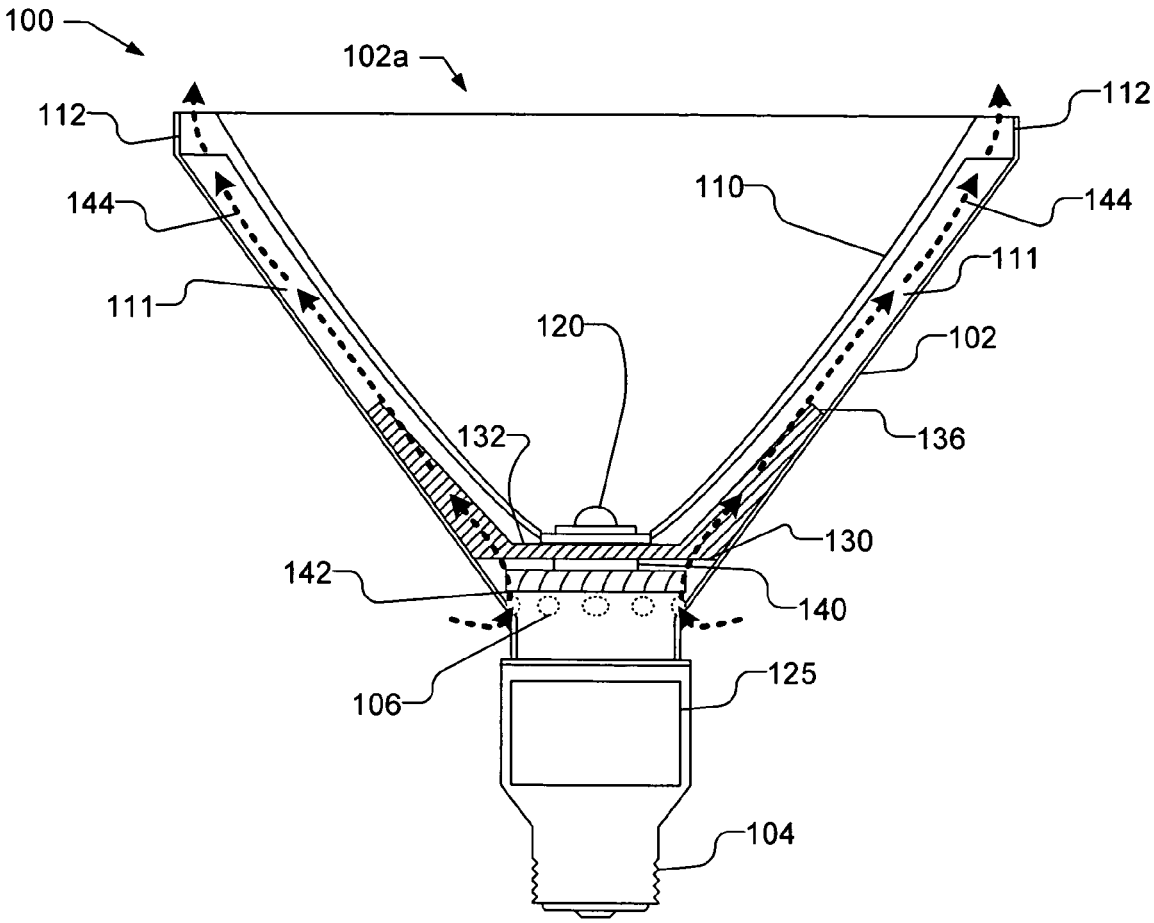
FIG. 3 illustrates a cross-sectional view of the LED lamp of FIG. 2.
Figure 4:
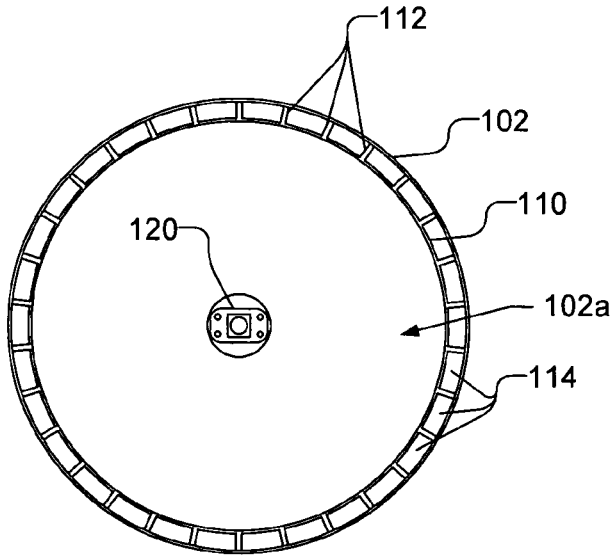
FIG. 4 illustrates a plan view of the top of the LED lamp of FIG. 2.

FIG. 3 illustrates a cross-sectional view of the LED lamp 100 and FIG. 4 is a plan view of the top of the LED lamp 100. As can be seen in FIG. 3, LED lamp 100 includes a parabolic optical reflector 110 or other optical element, such as total internal reflector (TIR), to control the direction of the emitted light. For ease of reference, the term optical reflector 110 will be used herein. However, it should be understood that use of the term optical reflector 110 refers to any element that controls the direction of the emitted light, including a parabolic reflector and a TIR. If desired, optical reflector 110 may extend beyond the opening 102*a* of the shell 102. As illustrated in FIGS. 3 and 4, a space is defined between the shell 102 and the optical reflector 110. The space between the shell 102 and optical reflector 110 serves as an air channel 111 as will be discussed in more detail below.

The optical reflector 110 is coupled to the shell 102 at the opening 102*a* of the shell 102 by a plurality of support fins 112. The optical reflector 110 may be attached to the shell 102 with glue, clips or spring tabs, by welding or by any other appropriate attachment means.

As can be seen in FIG. 4, the shell 102, the optical reflector 110 and the support fins 112 define a plurality of apertures 114, which serve as air exhaust or intake ports. It should be understood, that if desired, support fins 112 may be located elsewhere, e.g., within channel 111, so that only a single aperture 114 is formed, as defined by the shell 102 and the optical reflector 110.

The LED lamp 100 includes an AC/DC converter 125 that converts the AC power from the screw base 104 to DC power. In general, AC/DC converters are well known. The AC/DC converter 125 may be any conventional converter that is small enough to fit in the LED lamp 100 near the screw base 104.

An LED 120 is located at the base of the optical reflector 110 such that the optical reflector 110 can control the direction of the light emitted from the light emitting diode. The LED 120 is electrically coupled to the AC/DC converter 125. The LED 120 is, by way of example, a Luxeon 500 lm LED, which can be purchased from Lumileds Lighting U.S., LLC, located in San Jose, Calif. It should be understood that any desired LED may be used with the present invention. Moreover, while FIG. 3 illustrates a single LED 120 in the LED lamp 100, it should be understood that if desired, a plurality of LEDs may be used to generate the desired luminosity or the desired color of light.

Figure 4A:
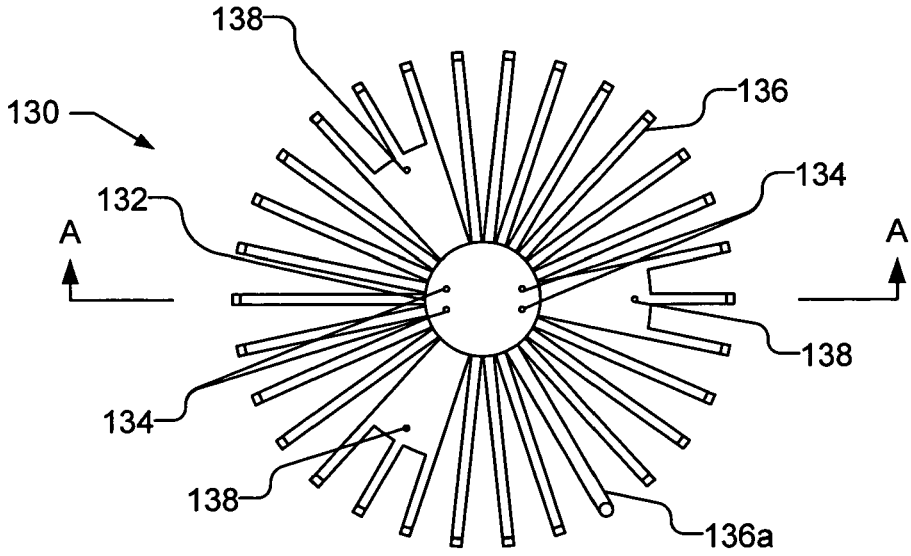
FIGS. 4A, 4B, and 4C, which show respective top plan, cross-sectional, and bottom plan views of a heat sink that may be used with the present invention.
Figure 4B:
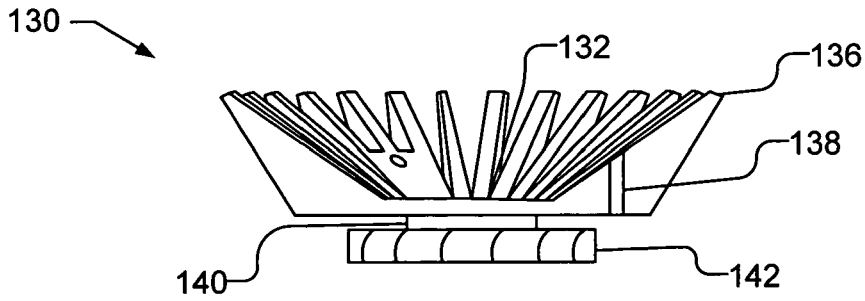
Figure 4C:
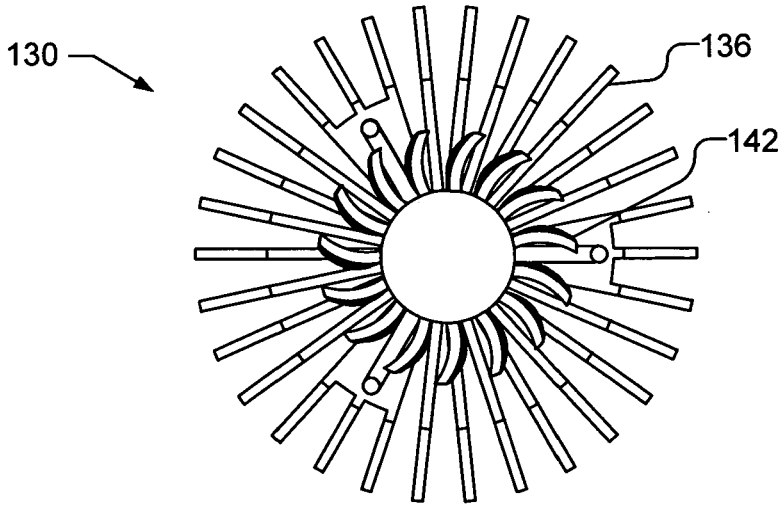

The LED 120 is mounted to a heat sink 130 by bolts, rivets, solder or any other appropriate mounting method. The heat sink 130 is, e.g., manufactured from aluminum, aluminum alloy, brass, steel, stainless steel, or any other thermally conductive materials, compounds, or composites. Heat sink 130 is shown in more detail in FIGS. 4A, 4B, and 4C, which show a top plan view, cross-sectional view (along line AA in FIG. 4A), and bottom plan view of heat sink 130 respectively. As illustrated in FIGS. 4A, 4B, and 4C, heat sink 130 includes a base 132 and a plurality of fins 136 extending from the base. If desired, heat pipes, illustrated by heat pipe 136*a*, may be used in place of fins 136, or a combination of fins and heat pipes may be used.

The base 132 of the heat sink 130 includes a plurality of apertures 134, which are used to mount the LED 120 to the top surface of the base 132 of the heat sink 130, e.g., by bolts or rivets. Of course, if desired, other appropriate, thermally conductive mounting means may be used, such as solder or epoxy. Moreover, it should be understood that the configuration of the heat sink may differ, for example, in a differently shaped LED lamp. Further, while the FIG. 3 illustrates the fins of heat sink 130 extending partially into the channel 111, it should be understood that, if desired, the fins may extend entirely through the channel 111. In a configuration where the fins 132 extend entirely through the channel 111, the need for support fins 112 for the optical reflector 110 may be obviated. The heat sink 130 may be held in position by press fitting between the exterior shell 102 and the optical reflector 110. Alternatively, the heat sink 130 may be coupled to one or both of the shell 102 and optical reflector 110, e.g., using glue, bolts, rivets or any other appropriate connection means.

As illustrated in FIGS. 4A and 4B, the fins 136 also include apertures 138. The apertures 138 are used to mount a motor 140 to the bottom side of the base 132 of the heat sink 130, e.g., using bolts or rivets. The motor 140 is use to drive a fan 142. The motor and fan are illustrated in FIGS. 4A and 4B. The motor 130 may be, by way of example, a brushless DC 12V motor and receives power from the AC/DC converter 125. The type and size of the motor and fan will depend on the size of the LED lamp 100 and the type of LED and how much heat is produced by the LED. By way of example, with an LED lamp 100 that has a form factor of a PAR38, i.e., 4 inches in diameter at the widest portion of the shell 102, and a Luxeon 500 lm LED, an adequate motor 130 and fan 132 may be purchased from Millennium Electronics Inc. located in San Jose, Calif., as Part No. 1035-C2, which has dimensions of 68×60×10 mm and produces 3.7 CFM. Of course, other types of motors, fans, and dimensions may be used if desired. www.Mei-thermal.com.

Figure 1:
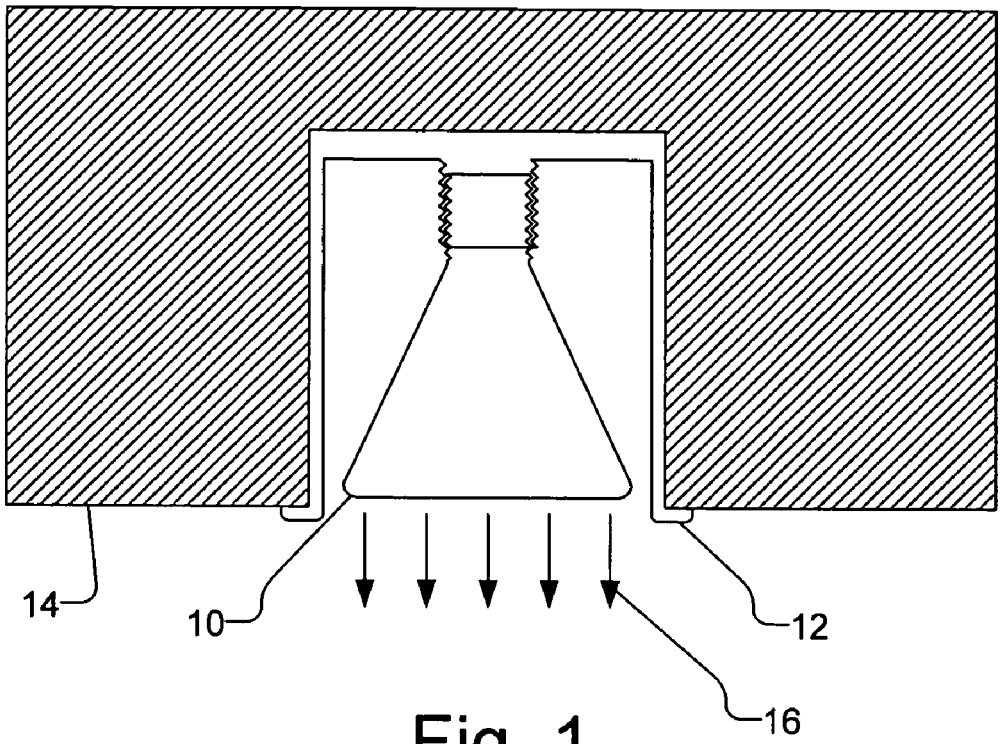
FIG. 1 illustrates a conventional PAR type lamp that is recessed into a can.

The fan 142 draws air through air inlet apertures 106 and moves the air over the heat sink 130 and through the channel 111 between the shell 102 and the optical reflector 110 and out through the exhaust apertures 114 defined by the shell 102, optical reflector 110 and fins 112. The flow of air is illustrated in FIG. 3 by broken arrows 144. The flow of air through channel 111, over the heat sink 130, and out exhaust apertures 114 effectively dissipates heat from the heat sink 130, and thus, the LED 120. The use of an air flow channel 111 that is in the general direction of the optical reflector 110 and exhaust apertures 114 that direct the flow of air out of the LED lamp 100 in the same general direction as the light produced by the LED lamp 100 is particularly advantageous where the LED lamp 100 is placed in a recessed area with limited space, such as that illustrated in FIG. 1. The form factor the LED lamp 100 can advantageously remain as small as a conventional light bulb while heat produced by the LED is effectively dissipated.

It should be understood that the motor 140 and fan 142 may be located in locations other than that shown in FIG. 3. For example, if desired, a motor and fan may be located near the opening 102*a* of the LED lamp 100 or within the channel 111.

Figure 5:
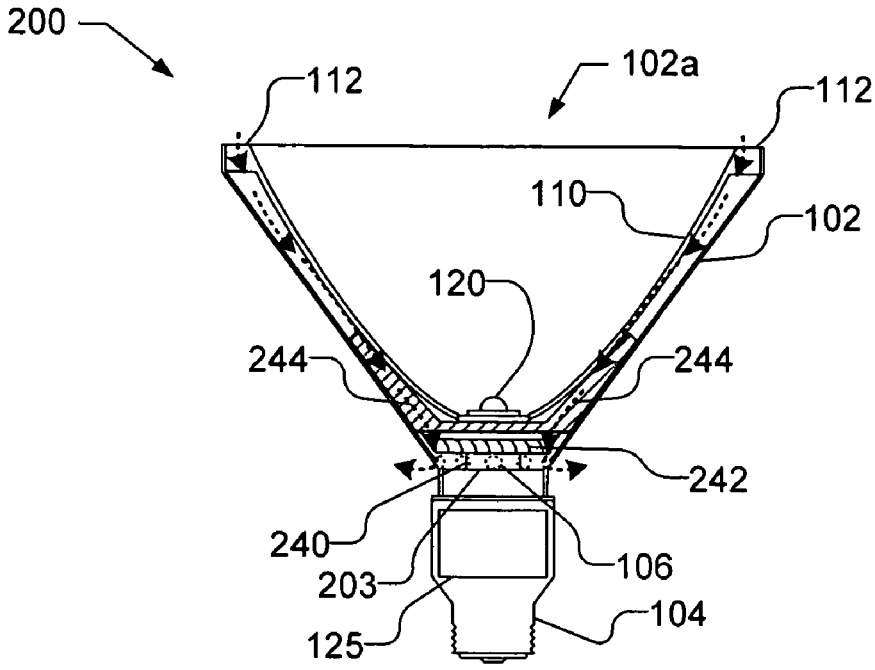
FIG. 5 illustrates a cross sectional view of another embodiment of an LED lamp in accordance with the present invention.

In another embodiment of the present invention, the direction of the air flow may be reversed. FIG. 5 illustrates a cross sectional view of a LED lamp 200, which is similar to LED lamp 100, like designated elements being the same. LED lamp 200, however, has the motor 240 and fan 242 reversed, with respect to the embodiment illustrated in FIG. 3. As shown in FIG. 5, the motor 240 is mounted to a plate

203 near the base 104 of the shell 102. With the reversed configuration of the motor 240 and fan 242, air is drawn through apertures 114, which thus serve as air inlet ports. The air is pulled through channel 111 and over the heat sink 130 and out apertures 106, which thus serve as exhaust ports. The air is illustrated in FIG. 5 as arrows 244.

Figure 6:
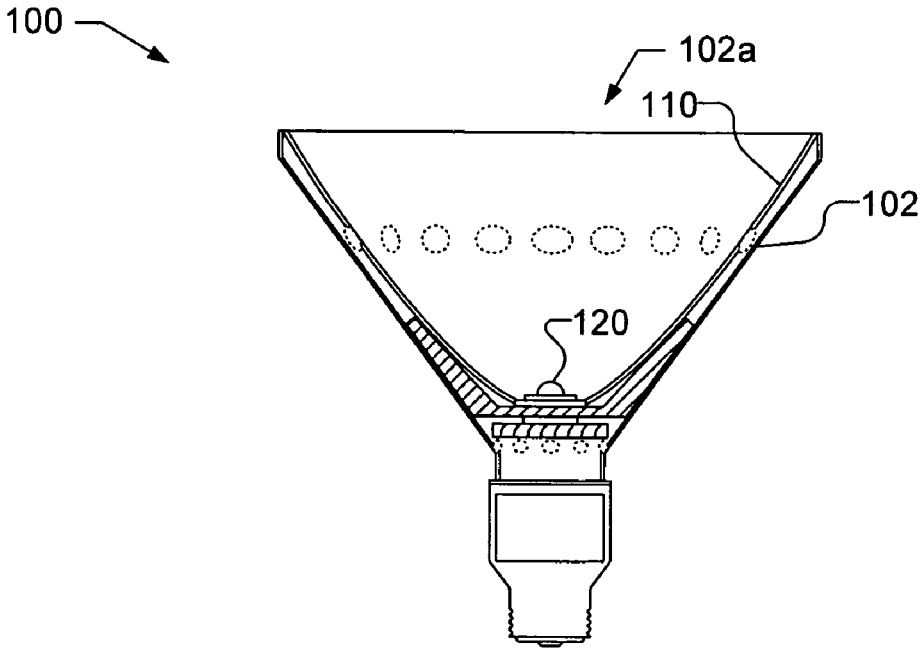
FIG. 6 illustrates a cross-sectional view of another embodiment of an LED lamp in accordance with the present invention.

It should also be understood that the present invention is not limited to the precise location of air inlet and outlet apertures. FIG. 6 illustrates a cross-sectional view of an LED lamp 300 in accordance with another embodiment of the present invention. LED lamp 300 is similar to LED lamp 100, like designated elements being the same. In addition to apertures 106 around the perimeter of the shell 102 near the base 104, LED lamp 300 also includes another set of apertures 314 that are approximately equally spaced around the perimeter of the shell 102 at approximately half the distance between the opening 102*a* and the LED 120. Apertures 314 are illustrated with broken lines in FIG. 6. The precise location of the apertures 314 may vary, but apertures 314 should be located to permit an adequate air flow over the heat sink 130 to produce the desired dissipation of heat. Moreover, as with apertures 106, it should be understood that if desired, a single, relatively large aperture may be used in place of apertures 314.

Figure 7:
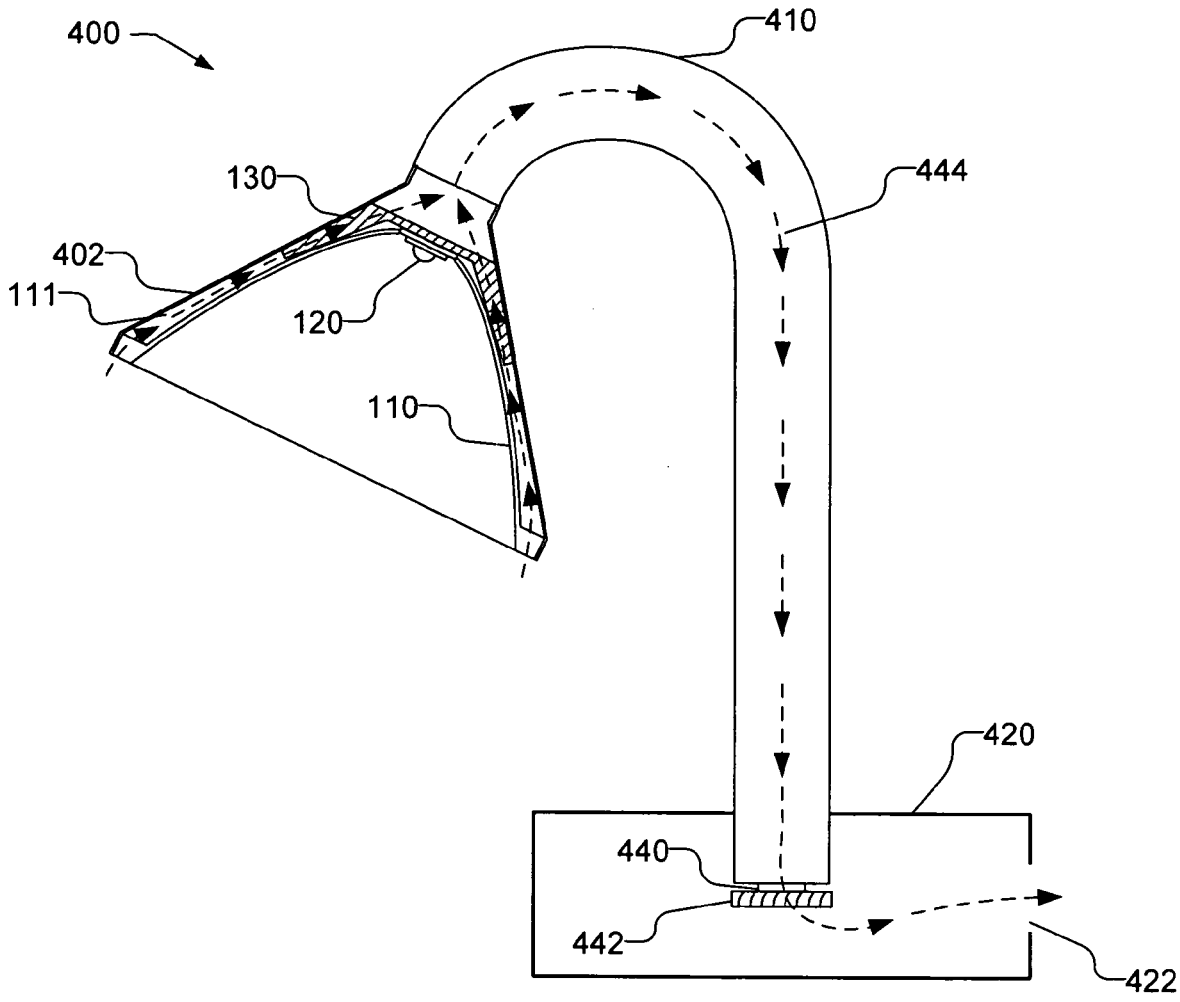
FIG. 7 illustrates a cross-sectional view of an LED lamp in accordance with another embodiment of the present invention.

FIG. 7 illustrates a cross-sectional view of an LED lamp 400 in accordance with another embodiment of the present invention, in which the fan and motor are not necessarily adjacent to the heat sink 130 or channel 111, but are in flow communication with channel 111, i.e., capable of moving air through the channel 111. LED lamp 400 is similar to LED lamp 200, like designated elements being the same. LED lamp 400, however, includes a hollow neck 410 that is coupled to and supports the shell 402 (along with the other components, such as the optical reflector 110, LED 120, etc.) and a base 420. The neck 410 may be rigid or flexible. As illustrated in FIG. 7, the LED lamp 400 includes a motor 440 and fan 442 that are located within the base 420. In operation, the fan 442 draws air through channel 111, over the heat sink 130 and through the neck 410 to the base 420, where the air is expelled through exhaust port 422. The air is illustrated in FIG. 5 as arrows 444. Of course, if desired, the flow of air may be in the reverse direction, e.g., by reversing the orientation of the motor 440 and fan 442. Further, the motor and fan may still be located adjacent to the heat sink 130, while causing the air to flow through the neck 410 and out the exhaust port 422 in the base. Thus, it should be understood, that the fan and/or the intake or exhaust apertures may be in locations that are not adjacent to the heat sink 130 or channel 111.

Figure 8:
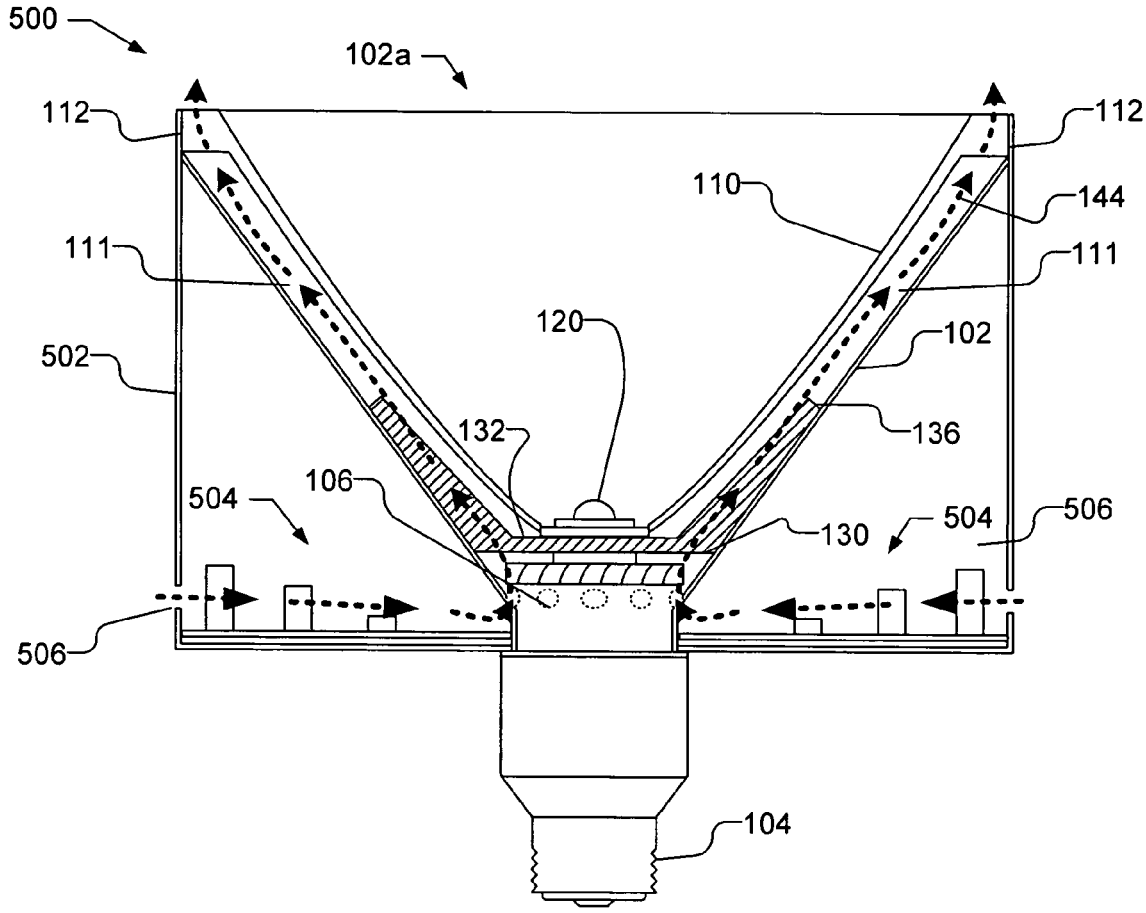
FIG. 8 illustrates a cross-sectional view of another embodiment of an LED lamp.

FIG. 8 illustrates a cross-sectional view of another embodiment of an LED lamp 500. LED lamp 500 is similar to LED lamp 100, like designated elements being the same. However, as illustrated in FIG. 8, an additional shell 502 is provide around shell 102. Within the shell 502 an AC/DC converter circuit 504 is provided. Apertures 506 within the shell 502 allow air to enter and flow over the AC/DC converter circuit 504 prior to being drawn into apertures 106, as indicated by arrows 508. In this embodiment, the AC/DC converter circuit 504 advantageously is cooled. Of course, if desired, the air flow may be reversed so that the air exits through apertures 506.

Although the present invention is illustrated in connection with specific embodiments for instructional purposes, the present invention is not limited thereto. Various adaptations and modifications may be made without departing from the scope of the invention. For example, various shapes of the LED lamp may be used with the present invention. Moreover, the air inlets and outlets, as well as the configuration of the heat sink and fan may be varied. Therefore, the spirit and scope of the appended claims should not be limited to the foregoing description.

What is claimed is:

1. An apparatus comprising:

a shell;

an optical reflector disposed at least partially within the shell, wherein a space is formed between the optical reflector and the shell;

at least one light emitting diode disposed within the optical reflector;

a heat sink disposed at least partially within the shell, the light emitting diode being mounted to the heat sink;

a motor and a fan in flow communication with the space, the fan being configured to move air over the heat sink and through the space; and a screw type electrical contact base coupled to the shell.

2. The apparatus of claim 1, wherein the fan is configured to move air over the heat sink before moving air through the space.

3. The apparatus of claim 1, wherein the shell has at least one air inlet aperture, the fan drawing air through the air inlet aperture.

4. The apparatus of claim 3, wherein the shell and optical reflector define at least one air exhaust aperture, wherein air is expelled through the at least one air exhaust aperture after moving over the heat sink.

5. The apparatus of claim 3, wherein the shell further has at least one air exhaust aperture, wherein air is expelled through the at least one air exhaust aperture after moving over the heat sink.

6. The apparatus of claim 3, wherein the shell has a plurality of air inlet apertures located near the screw type electrical contact base.

7. The apparatus of claim 1, wherein the shell and optical reflector define at least one air inlet aperture and the shell further has at least one air exhaust aperture, wherein the fan draws air through the air inlet aperture and moves air through the space, over the heat sink and through the air exhaust aperture.

8. The apparatus of claim 1, wherein the heat sink includes at least one of a plurality of fins and a plurality of heat pipes that extend into the space.

9. The apparatus of claim 1, wherein the motor and fan are within the shell.

10. The apparatus of claim 1, further comprising an AC to DC converter coupled to the a screw type electrical contact base.

11. The apparatus of claim 10, wherein the AC to DC converter is coupled to at least one of the motor and the at least one light emitting diode.

12. An apparatus comprising:

a shell;

an optical reflector disposed at least partially within the shell, wherein a space is formed between the optical reflector and the shell;

at least one light emitting diode disposed within the optical reflector;

a heat sink disposed at least partially within the shell, the light emitting diode being mounted to the heat sink;

a motor and a fan in flow communication with the space, the fan being configured to move air over the heat sink and through the space; and a hollow neck coupled to the shell and a base coupled to the hollow neck, wherein the motor and fan are within the base.

13. An apparatus comprising:

a light emitting diode;

an optical reflector that controls the direction of light emitted from the light emitting diode;

a heat sink, the light emitting diode being mounted on the heat sink;

a fan for moving air over the heat sink; and an air flow channel through which the fan moves air, the air flow channel follows the general outline of the optical; and a screw type electrical contact base coupled to the optical reflector.

14. The apparatus of claim 13, wherein the air flow channel is at least partially defined by the optical reflector.

15. The apparatus of claim 13, wherein the heat sink comprises at least one of a plurality of fins and a plurality of heat pipes that extend in the general direction of the optical reflector.

16. The apparatus of claim 13, further comprising an AC to DC converter coupled to the a screw type electrical contact base.

17. The apparatus of claim 16, wherein the AC to DC converter is coupled to at least one the light emitting diode and a motor for driving the fan.

18. An apparatus comprising:

a light emitting diode;

an optical reflector that controls the direction of light emitted from the light emitting diode;

a heat sink, the light emitting diode being mounted on the heat sink;

a fan for moving air over the heat sink;

an air flow channel trough which the fan moves air, the air flow channel follows the general outline of the optical reflector, the air flow channel is at least partially defined by the optical reflector; and an exterior shell in which the optical reflector is at least partially disposed, wherein the air flow channel is further defined by the exterior shell.

19. The apparatus of claim 18, wherein the exterior shell has a plurality of apertures through which air is drawn prior to being moved over the heat sink.

20. An apparatus comprising:

a light emitting diode;

an optical reflector that controls the direction of light emitted from the light emitting diode;

a heat sink, the light emitting diode being mounted on the heat sink;

a fan for moving air over the heat sink; and an air flow channel trough which the fan moves air, the air flow channel follows the general outline of the optical reflector;

a hollow support element that is coupled to the optical reflector and heat sink, wherein the hollow support element defines a portion of the air flow channel; and a base coupled to the hollow support element, wherein the fan is within the base.

* * * * *